US005123869A

United States Patent [19]

Schipmann

[11] Patent Number: 5,123,869

[45] Date of Patent: Jun. 23, 1992

[54] AERODYNAMIC TOY

[76] Inventor: William C. Schipmann, P.O. Box 67, St. Stephen, S.C. 29479

[21] Appl. No.: 729,351

[22] Filed: Jul. 12, 1991

[51] Int. Cl.[5] ..... A63H 27/00; A63H 27/10

[52] U.S. Cl. ..... 446/46; 446/225

[58] Field of Search ..... 446/46, 47, 48, 225, 446/223, 220; 273/424, 425, 428

[56] References Cited

U.S. PATENT DOCUMENTS

| | | | |
|---|---|---|---|
| 1,858,460 | 5/1932 | Ranseen | 446/225 X |
| 4,115,946 | 9/1978 | Vukmirovich | 273/424 X |
| 4,241,533 | 12/1980 | Newsome | 446/46 |
| 5,045,011 | 9/1991 | Lovik | 273/428 X |

FOREIGN PATENT DOCUMENTS

| | | | |
|---|---|---|---|
| 1207813 | 7/1986 | Canada | 273/424 |

*Primary Examiner*—Mickey Yu
*Attorney, Agent, or Firm*—Leon Gilden

[57] ABSTRACT

An aerodynamic toy is arranged formed of a flexible web formed of memory retentent material, with the web of an annular configuration, including a continuous peripheral array of pockets about the web, with each pocket selectively mounting a weighted disk therewithin to accommodate removal of selective weights to effect flight and trajectory of the toy. The toy may further be provided in a modified construction to include essentially oriented and positionable a helium filled balloon.

7 Claims, 4 Drawing Sheets

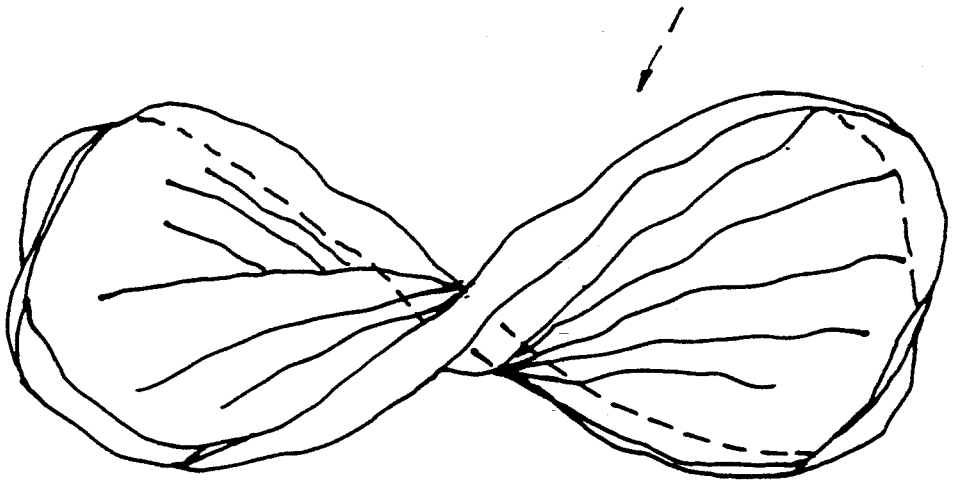
Fig 1
PRIOR ART
Fig 2
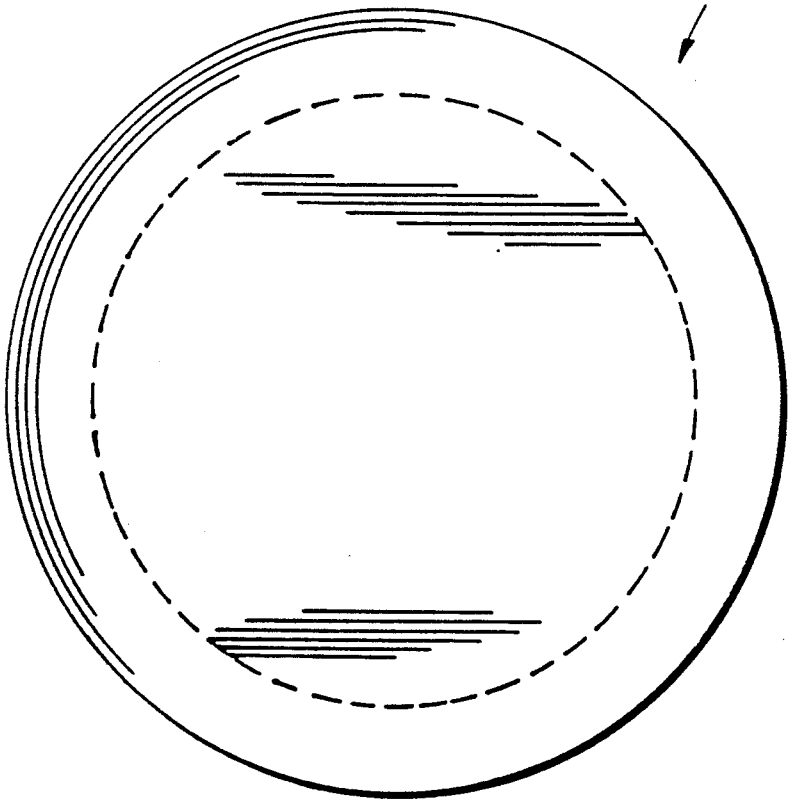
PRIOR ART

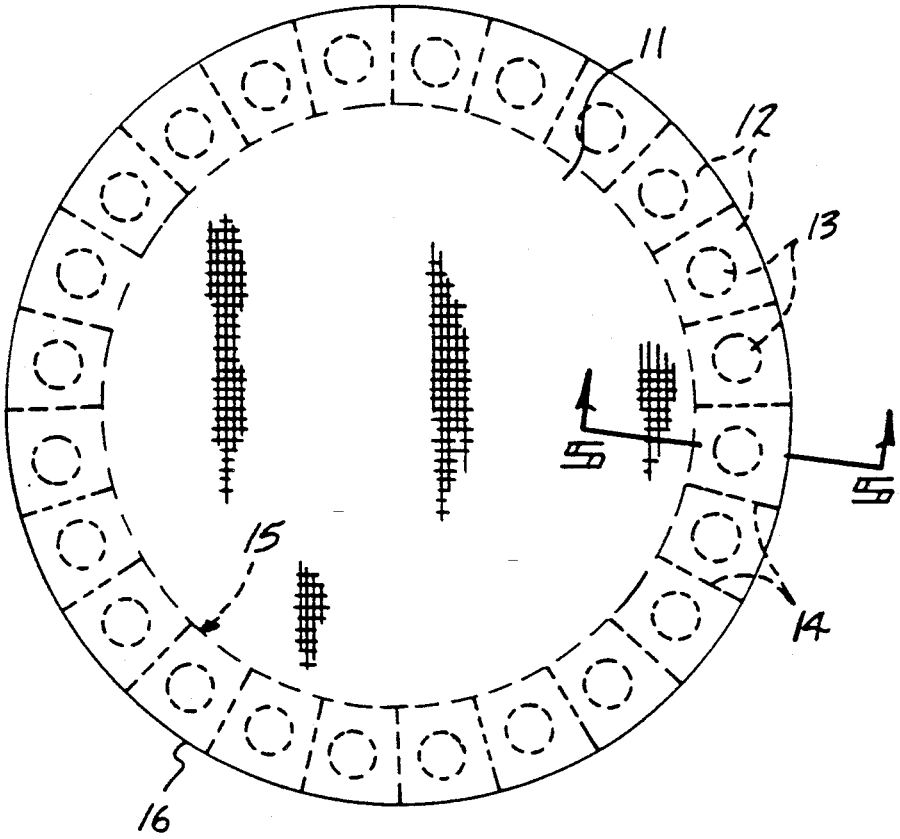
FIG 4
FIG 5
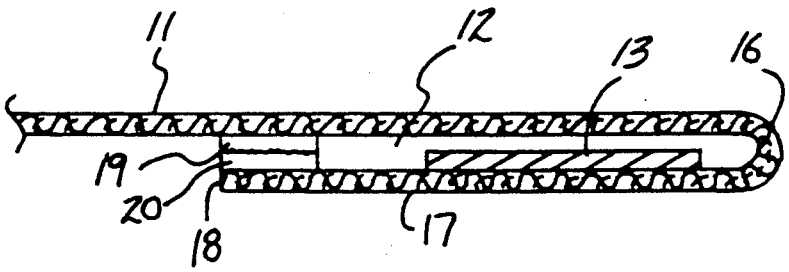

AERODYNAMIC TOY

BACKGROUND OF THE INVENTION

1. Field of the Invention

The field of invention relates to toy structure, and more particularly pertains to a new and improved aerodynamic toy wherein the same is arranged for trajectory imparted by manual throwing of the toy and rotational motion directed thereto to stabilize a toy in flight.

2. Description of the Prior Art

Various saucer-like toys and disks are provided in the prior art and are formed of various materials, typically of a rigid construction. A flexible material type disk is set forth in U.S. Pat. No. 4,832,652 to Matsuyama that may be folded for throwing the toy to be subsequently opened during flight.

U.S. Pat. No. 4,196,540 to Hembree, et al. sets forth a further example of an aerodynamic toy formed of a flexible foam material of uniform density, including a concave bottom surface.

U.S. Pat. No. 4,568,297 to Dunipace provides a toy formed of a flexible material defining a disk structure.

U.S. Pat. No. 4,205,484 to Kovac, et al. and U.S. Pat. No. 4,378,653 to O'Brien are further examples of disk-like aerodyamic toys of generally annular configuration, with concave cavities directed therewithin.

As such, it may be appreciated that there continues to be a need for a new and improved aerodynamic toy as set forth by the instant invention which addresses both the problems of ease of use as well as effectiveness in construction permitting adjustment of trajectory of the toy in flight and in this respect, the present invention substantially fulfills this need.

SUMMARY OF THE INVENTION

In view of the foregoing disadvantges inherent in the known types of toy apparatus now present in the prior art, the present invention provides an aerodynamic toy wherein the same is formed of a flexible memory retentent material utilizing removable weights to effect trajectory of the toy in flight. As such, the general purpose of the present invention, which will be described subsequently in greater detail, is to provide a new and improved aerodynamic which has all the advantages of the prior art toy apparatus and none of the disadvantages.

To attain this, the present invention provides an aerodynamic toy arrangement formed of a flexible web formed of memory retentent material, with the web of an annular configuration, including a continuous peripheral array of pockets about the web, with each pocket selectively mounting a weighted disk therewithin to accommodate removal of selective weights to effect flight and trajectory of the toy. The toy may further be provided in a modified construction to include essentially oriented and positionable a helium filled balloon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved aerodynamic toy which has all the advantages of the prior art toy apparatus and none of the disadvantages.

It is another object of the present invention to provide a new and improved aerodynamic toy which may be easily and efficiently manufactured and marketed.

It is a further object of the invention to provide a new and improved aerodynamic toy which is of a durable and reliable construction.

An even further object of the present invention is to provide a new and improved aerodynamic toy which is susceptible of a low cost of manufacture with regard to both materials and labor, and which accordingly is then susceptible of low prices of sale to the consuming public, thereby making such aerodynamic toys economically available to the buying public.

Still yet another object of the present invention is to provide a new and improved aerodynamic toy which provides in the apparatuses and methods of the prior art some of the advantages thereof, while simultaneously overcoming some of the disadvantages normally associated therewith. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawing and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art aerodynamic toy.

FIG. 2 is an orthographic top view of a further example of a throwing disk utilized in the prior art.

FIG. 4 is a top orthographic view of the instant invention.

FIG. 6 is an orthographic top view of a modification of the instant invention.

FIG. 7 Is an orthographic view, taken along the lines 7—7 of FIG. 6 in the direction indicated by the arrows.

DESCRIPTION OF THE PREFERRED EMBODIMENT

Figure 3:
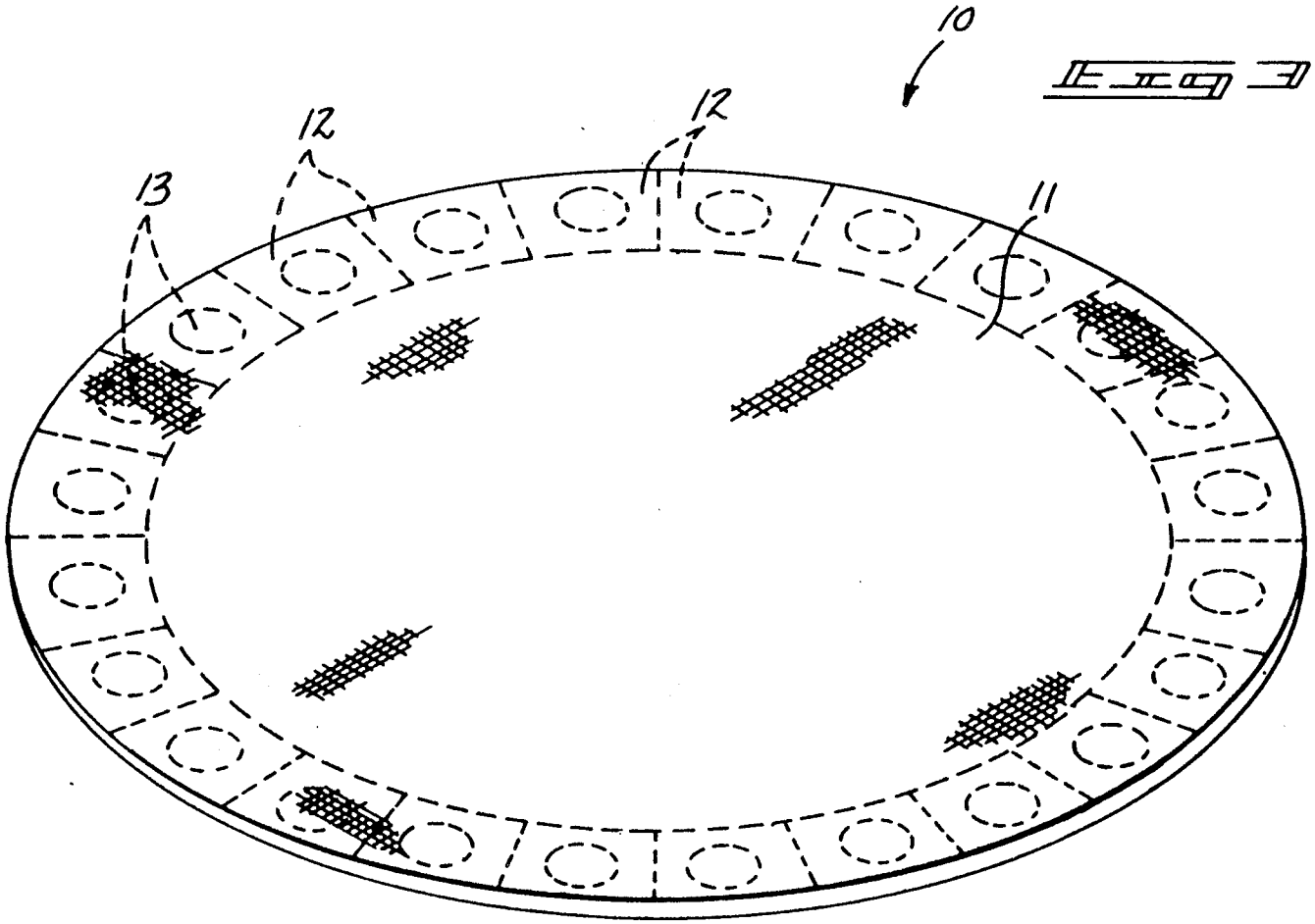
FIG. 3 is an isometric illustration of the instant invention.

With reference now to the drawings, and in particular to FIGS. 1 to 7 thereof, a new and improved aerodynamic toy embodying the principles and concepts of the present invention and generally designated by the reference numerals 10 and 10*a* will be described.

FIG. 1 illustrates a prior art toy structure, as set forth in U.S. Pat. No. 4,832,652, wherein the toy may be folded when initially thrown to open during flight from a position, as illustrated by the numeral 1 in FIG. 1. FIG. 2 sets forth a further prior art toy 2, set forth in U.S. Pat. No. 4,196,540, formed of a foam-like material of uniform density, with a central concave pocket through a bottom surface thereof.

More specifically, the aerodynamic toy 10 of the instant invention essentially comprises a flexible annular disk web 11 formed of a deformable memory retentent material to define the annular configuration, as illustrated in FIG. 3, that includes a peripheral series of pockets 12 coextensively formed about the periphery of the web 11. Each pocket includes a selectively removable disk weight 13. Radially arranged seams 14 defining intersections of adjacent pockets are provided to prevent undue displacement of the disks within the pockets during flight. Each pocket extends to an inner circular perimeter 15 that is concentric with and positioned interiorly of an outer circular perimeter 16 defining outer and inner edges of the pockets. Each pocket includes a pocket flap 17, including a pocket flap edge 18 that is coextensively arranged relative to each edge with the inner circular perimeter 15. A first hook and loop fastener surface 19 is mounted to be the web 11 for selective securement to a second hook and loop fastener 20 mounted to an interior confronting surface of an associated pocket flap 17 for securement of each pocket flap 17 to the web 11 and thereby selectively contain the disk 13 within each pocket 12, as desired. The disks 13 may be removed to provide a wobble type effect to permit lightening of the disk for flight. The disk is readily interfold for storage and transport of the disk structure.

Figures 5, 11:
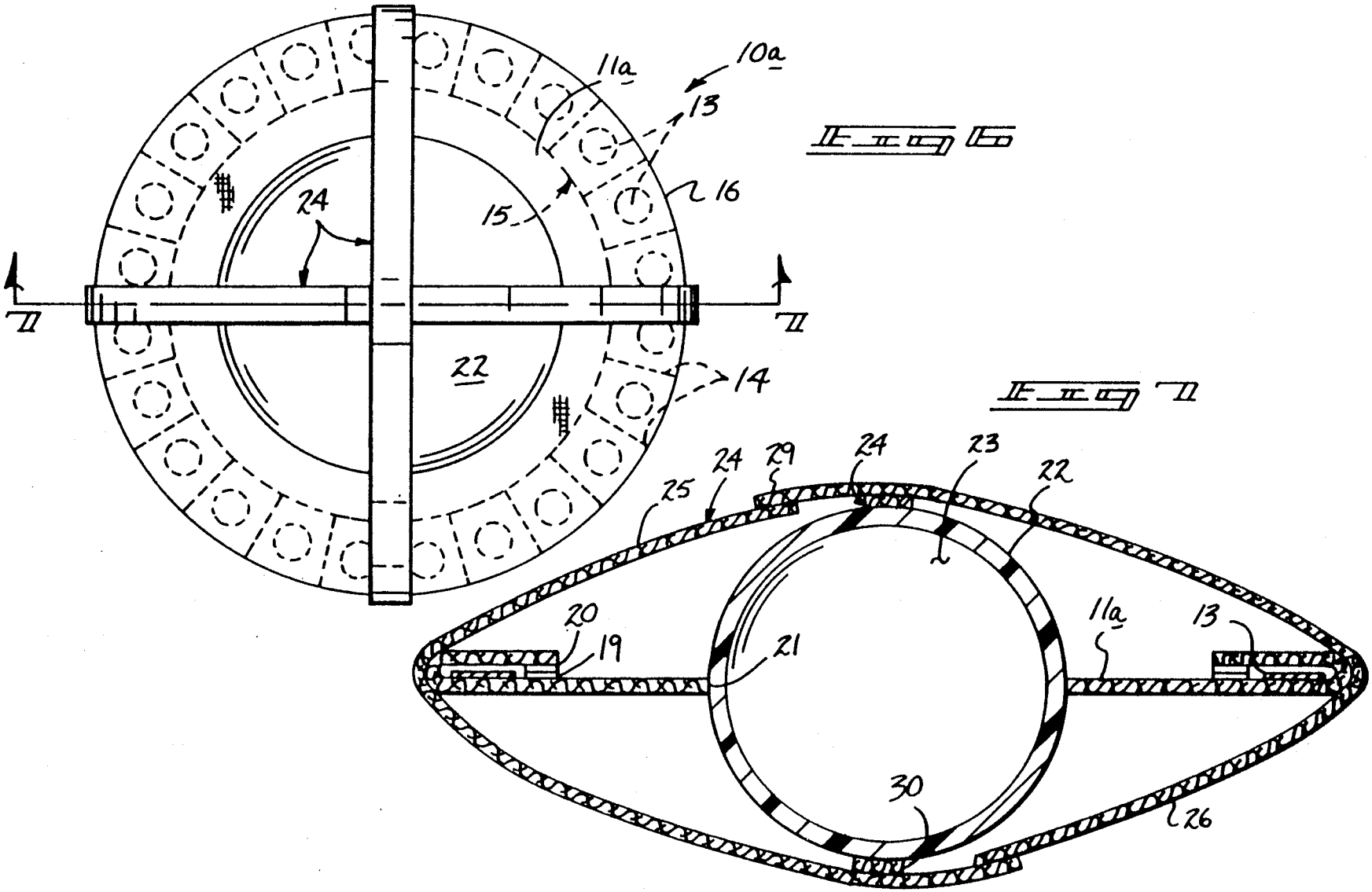
FIG. 5 is an orthographic view, taken along the lines 5—5 of FIG. 4 in the direction indicated by the arrows.

FIGS. 6 and 7 illustrate a modified toy construction 10*a*, wherein the use of a modified annular disk 11 is constructed, in a manner as set forth in the description of the toy of FIGS. 3-5, but includes a central web opening 21 directed medially and coaxially of the modified web 11 *a* defining a predetermined diameter to receive a spherical balloon 22 defining a diameter equal to the predetermined diameter. The spherical balloon 22 includes a gas chamber 23 to include compressed air or helium to effect flight of the balloon. A plurality of strap loops 24 intersect orthogonally relative to one another, wherein the strap loops are directed diametrically about the spherical balloon and modified web 11*a*. Each of the strap loops 24 is formed of a respective first and second strap 25 and 26 secured together by third and fourth hook and loop fastener surfaces 29 and 30 to engage free terminal ends of the strap together to accommodate adjustment of the straps in mounting the straps relative to the modified web 11*a* and the balloon 22.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An aerodynamic toy, comprising, an annular flexible disk web formed of memory retentent material defined between an outer circular perimeter edge spaced from and concentric with an inner circular perimeter edge positioned interiorly of the outer circular perimeter edge, and a plurality of peripheral pockets, each pocket of said peripheral pockets including a pocket flap, wherein each pocket flap is hingedly mounted to the outer circular perimeter edge and extends radially interiorly of the web to the inner circular perimeter edge.

2. An apparatus as set forth in claim 1 wherein each pocket includes a disk member, each disk member removably mounted relative to each pocket.

3. An apparatus as set forth in claim 2 wherein each of said peripheral pockets includes seams extending radially from the outer circular perimeter edge to the inner circular perimeter edge.

4. An apparatus as set forth in claim 3 wherein each flap includes a flap edge, each flap edge is aligned with the inner circular perimeter edge, and each flap includes a first hook and loop fastener mounted to the flap in confrontation with a second hook and loop fastener mounted to the web permitting selective securement of each flap relative to the web.

5. An apparatus as set forth in claim 4 wherein the web includes a central web opening defined by a predetermined diameter coaxially directed through the web, and a spherical balloon mounted within the central web opening, the spherical balloon defined by a balloon diameter equal to the predetermined diameter.

6. An apparatus as set forth in claim 5 including a plurality of strap loops orthogonally intersecting relative to one another, wherein each strap loop is diametrically mounted in a surrounding relationship relative to the web and balloon.

7. An apparatus as set forth in claim 6 wherein each strap loop includes a first and second strap member, each strap member includes a cooperating third and fourth hook and loop fastener surface mounted at respective opposed end portions of each strap member for securement of the strap members of each strap loop together.

* * * * *